US005590641A

United States Patent [19]

Duong

[11] Patent Number: 5,590,641

[45] Date of Patent: Jan. 7, 1997

[54] ADAPTOR FOR INSTALLING FLUE LINERS TO DIRECT VENT FIREPLACE INSERTS

[75] Inventor: Luu Q. Duong, Ontario, Canada

[73] Assignee: CFM International Inc., Mississauga, Canada

[21] Appl. No.: 461,431

[22] Filed: Jun. 5, 1995

[30] Foreign Application Priority Data

Jan. 26, 1995 [GB] United Kingdom ..... 9501497

[51] Int. Cl.[6] ..... F24B 1/189

[52] U.S. Cl. ..... 126/85 B; 126/515

[58] Field of Search ..... 126/85 B, 515–518, 126/77, 512

[56] References Cited

U.S. PATENT DOCUMENTS 4,111,004 9/1978 Blomberg ..... 126/85 B

FOREIGN PATENT DOCUMENTS 1281249 3/1991 Canada .

*Primary Examiner*—Carroll B. Dority
*Attorney, Agent, or Firm*—Oliff & Berridge

[57] ABSTRACT

A method and adaptor assembly are provided for installing a direct vent firebox, such as a gas fireplace insert, into an existing fireplace. An exhaust flue liner and inlet flue liner are installed in the chimney of the existing fireplace. A plate flue collar is aligned above a fastener plate flue collar. The lower ends of the exhaust flue liner and inlet flue liner are connected to the fastener plate flue collar above an exhaust opening and inlet opening formed in the fastener slider plate, respectively. Slider brackets are provided on the top panel of the firebox and the plate flue collar is slidably engaged with the slider brackets while the firebox is inserted into the existing fireplace until the exhaust opening formed in the plate flue collar and the exhaust opening formed in the fastener plate flue collar are aligned with the exhaust opening formed in the top panel of the firebox and the inlet opening formed in the plate flue collar and the inlet opening formed in the fastener plate flue collar are aligned with the inlet opening formed in the top panel of the firebox.

16 Claims, 6 Drawing Sheets

ADAPTOR FOR INSTALLING FLUE LINERS TO DIRECT VENT FIREPLACE INSERTS

FIELD OF THE INVENTION

The present invention relates to direct vent fireplace inserts and more particularly to an adaptor for installing flue liners in a chimney and to the direct vent fireplace insert.

BACKGROUND OF THE INVENTION

In the installation and use of a gas fireplace insert, a flue liner must be provided to conduct the flue gases from the firebox of the fireplace insert to the chimney of the fireplace. As well, with direct vent fireplace inserts, fresh air from the outside is fed to the firebox for combustion. A second flue liner is needed to carry this fresh air down the chimney to the firebox where combustion occurs.

Typically, the flue liner for the exhaust gases is connected to the outlet opening on the firebox and pushed upwards into the fireplace chimney to ensure that the exhaust gases are directed entirely up the chimney so that no exhaust gases can leak into the space between the firebox and the fireplace, thereby escaping into the room. As well, the flue liner for the inlet fresh air should be inserted well into the chimney and apart from the exhaust gas flue liner to ensure that only fresh air is fed to the firebox, and not exhaust gases.

In the past, it has been problematic to install flue liners to gas fireplace inserts because of the extremely restricted amount of space between the fireplace insert and the walls of the fireplace cavity when the fireplace insert is inserted into the fireplace. Therefore, it is often very difficult to maneuver the flue liners up the chimney or to connect the flue liners properly to the firebox to ensure a tight and leak-proof connection.

With a direct vent gas fireplace insert, it is necessary, in order to achieve high efficiency, that there is a tight, leak-proof connection of the flue liners to the fireplace insert, thereby creating a continuous circuit of flowing gases. That is, there should not be any leaks of gases between the inlet of the fresh air flue liner and the outlet of the exhaust gas flue liner so that there are no exhaust gases that leak into the room nor any room air sucked into the firebox and combusted. This substantial leak-proof continuous circuit of flowing gases must be maintained, particularly at the points or the two flue liners connect to the gas fireplace insert.

In Canadian Patent No. 1,281,249 issued on Mar. 12, 1991 and currently standing in the name of the Applicant herein, a method and adaptor for installing a flue liner to a fireplace insert is disclosed. In that case, the fireplace insert is not a direct vent fireplace insert, thus it is not necessary to keep a strict leak-proof circuit of flowing gases. In fact, because it is not a direct vent fireplace, the insert does not have a fresh air inlet to the firebox, thereby not necessitating a second flue liner. As such, a leak-proof circuit between the fresh air inlet and the exhaust air outlet is not required. The fireplace insert in that case uses room air for combustion instead of fresh outside air.

In U.S. Pat. No. 1,281,249, the adaptor is described as a sliding flue liner adaptor on which the lower end of the flue liner is connected. The adaptor then engageably slides in brackets located on top of the fireplace insert when the insert is placed in the fireplace cavity. An opening is located in the adaptor where the flue liner connects thereto, and the opening is disposed such that it corresponds with the exhaust opening in the firebox when the adaptor is slid fully into the brackets. The adaptor may then be secured to the fireplace insert. The result is the simple connection and installation of the exhaust flue liner to the fireplace insert.

There is a need, therefore, for an adaptor to be used to install direct vent gas fireplace inserts, and to make the connection of the flue liners to the insert easier.

SUMMARY OF THE INVENTION

Accordingly, the present invention provides a simple and easy-to-use adaptor for installing flue liners to direct vent gas fireplace inserts. The adaptor of the present invention creates a substantial leak-proof connection between the adaptor itself and the top of the fireplace insert thereby ensuring that a substantially closed, continuous circuit for the flow of gases is maintained.

An object of the present invention, therefore, is to provide a method for installing a direct vent gas fireplace insert, an exhaust flue liner and an inlet flue liner in a fireplace with a chimney.

A further object of the present invention is to provide an adaptor assembly for installing a direct vent gas fireplace insert, an exhaust flue liner and an inlet flue liner in a fireplace with a chimney.

In accordance with one aspect of the present invention, there is provided a method of installing a direct vent gas fireplace insert, an exhaust flue liner and an inlet flue liner in an existing fireplace with a chimney, the direct vent gas fireplace insert comprising a firebox, a top panel defining an exhaust opening and an inlet opening formed in the top panel, and means for slidably receiving a plate flue collar, the method comprising the steps of:

(a) inserting the exhaust flue liner and inlet flue liner into the chimney whereby a lower end of the exhaust flue liner and a lower end of the inlet flue liner are accessible from the fireplace;

(b) aligning the plate flue collar on a fastener plate flue collar whereby an exhaust opening formed in the plate flue collar is above an exhaust opening formed in the fastener plate flue collar and an inlet opening formed in the plate flue collar is above an inlet opening formed in the fastener plate flue collar;

(c) coupling the lower end of the exhaust flue liner and the lower end of the inlet flue liner to the fastener plate flue collar, whereby the coupled lower end of the exhaust flue liner is over the exhaust opening formed in the fastener plate flue collar and the coupled lower end of the inlet flue liner is over the inlet opening formed in the fastener plate flue collar; and (d) slidably mounting the plate flue collar onto the means for slidably receiving the plate flue collar while inserting the fireplace insert into the existing fireplace until the exhaust opening formed in the plate flue collar and the exhaust opening formed in the fastener plate flue collar are substantially aligned with the exhaust opening formed in the top panel and the inlet opening formed in the plate flue collar and the inlet opening formed in the fastener plate flue collar are substantially aligned with the inlet opening formed in the top panel.

In accordance with a further aspect of the present invention, there is provided an adaptor assembly for installing a direct vent gas fireplace insert, an exhaust flue liner and an inlet flue liner in an existing fireplace with a chimney, the gas fireplace insert comprising a firebox, a top panel defining an exhaust opening and an inlet opening formed in the top panel, the adaptor assembly comprising:

(a) a plate flue collar defining an exhaust opening and an inlet opening formed in the plate flue collar;

(b) a fastener plate flue collar defining an exhaust opening and an inlet opening formed in the fastener flue plate collar;

(c) means for coupling the fastener plate flue collar to a lower end of the exhaust flue liner whereby the lower end of the exhaust flue liner is over the exhaust opening formed in the fastener plate flue collar;

(d) means for coupling the plate flue collar to a lower end of the inlet flue liner whereby the lower end of the inlet flue liner is over the inlet opening formed in the fastener plate flue collar;

(e) means operative for mounting on the top panel of the fireplace insert for slidably receiving the plate flue collar, whereby when the plate flue collar is fully received, the plate flue collar is aligned above the fastener plate flue collar and the exhaust opening formed in the top panel is in substantial alignment with the exhaust opening formed in the plate flue collar and the exhaust opening formed in the fastener plate flue collar and the inlet opening formed in the top panel is in substantial alignment with the inlet opening formed in the plate flue collar and the inlet opening formed in the fastener plate flue collar.

BRIEF DESCRIPTION OF THE DRAWINGS

One embodiment of the present invention will be described in greater detail with reference to the accompanying drawings, in which.

Figure 1:
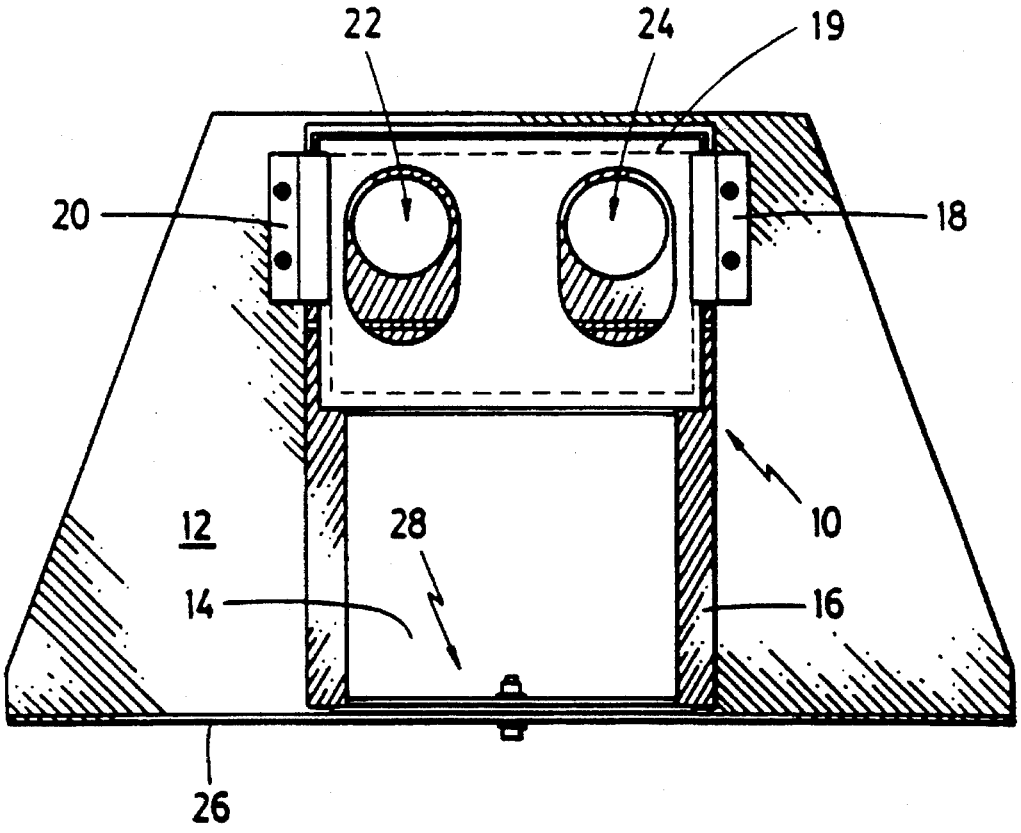
FIG. 1 shows a top view of one embodiment of the adaptor of the present invention installed on the top of a direct vent fireplace insert.

In the drawings, preferred embodiments of the invention are illustrated by way of example. It is to be expressly understood that the description and drawings of the preferred embodiments are only for the purpose of illustration and as an aid to understanding the present invention, and are not intended as a definition of the limits of the invention.

DETAILED DESCRIPTION OF THE PREFERRED EMBODIMENTS

Referring to FIG. 1, the flue liner adaptor of the present invention (generally denoted by the numeral 10) is shown mounted to the top panel 12 of a direct vent gas fireplace insert (not shown in its entirety in FIG. 1 ). The adaptor 10 consists of two main components, referred to herein as a plate flue collar 14 and a fastener plate flue collar 16. The embodiment of the present invention shown in the Figures also includes a pair of rails 18 and 20 adapted to be mounted on the top panel 12 of the insert. It will be understood, however, that it is not strictly necessary to have a pair of rails as shown in the preferred embodiment, rather any mechanism that serves the same function as rails 18 and 20 can be used. The rails 18 and 20 serve two main functions: they guide and retain the adaptor 10 in place on the top panel 12 of the insert, and they assist in creating a leak-proof seal between the adaptor 10 and the firebox of the fireplace insert. These functions will be discussed in greater detail below. Accordingly, rails 18 and 20 can be substituted with other means, such as locking clips or the like.

Each of the plate flue collar 14 and fastener plate flue collar 16 of the adaptor 10 has two openings (generally denoted as 22 and 24 in FIG. 1). Opening 22 is for the intake air (fresh air inlet) to the firebox for combustion therein. Opening 24 is for the combustion air (exhaust gas outlet) for removing the exhaust gases from the firebox. The openings 22 and 24 are located in each of plates 14 and 16 of adaptor 10 such that the openings in each plate align themselves respectively with the fresh air inlet and exhaust air outlet in the top panel 12 of the fireplace insert when the adaptor 10 is mounted on the top panel 12 of the insert.

Figure 5:
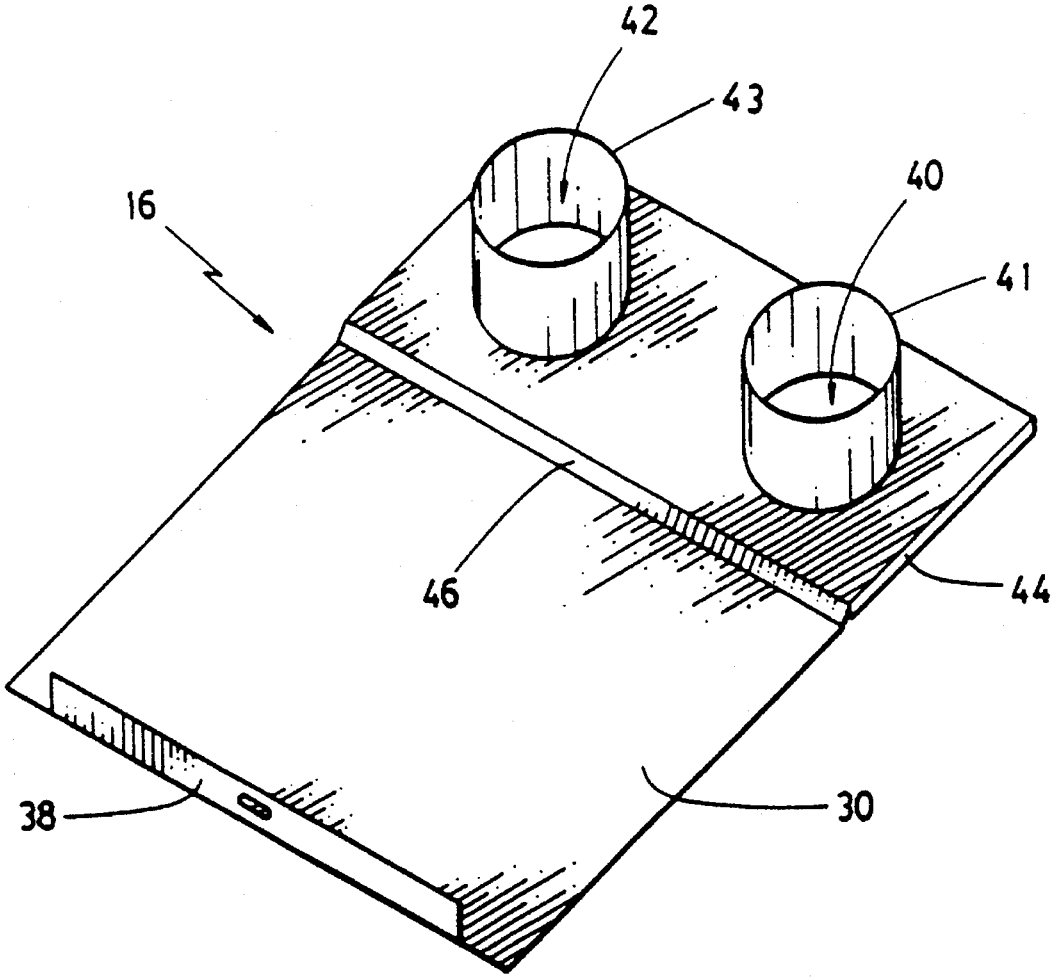
FIG. 5 is a perspective view of the plate flue collar shown in FIG. 2.

The top panel 12 of the fireplace insert includes an upstanding front flange 26 at the front edge of the top panel 12. Each of plates 14 and 16 also include upstanding front flanges (not specifically shown in FIG. 1, but shown in FIGS. 2, 3 and 5) at their respective front edges, denoted in FIG. 1 generally by numeral 28. Upstanding flange 26 on the top panel 12 and the upstanding flanges 28 on the plates 14 and 16 are used to fasten the adaptor 10 to the top panel 12 once the adaptor is mounted thereon.

Plate flue collar 14 is adapted to lie on top of fastener plate flue collar 16 such that fastener plate 16 is disposed intermediate plate 14 and top panel 12 of the fireplace insert. Fastener plate flue collar 16 creates a seal between the firebox of the fireplace insert and the openings 22 and 24 so that substantially no leaks can occur. Plate flue collar 14, on the other hand, cooperates with rails 18 and 20 to assist in creating the leak-proof seal, as will be discussed below.

Figure 2:
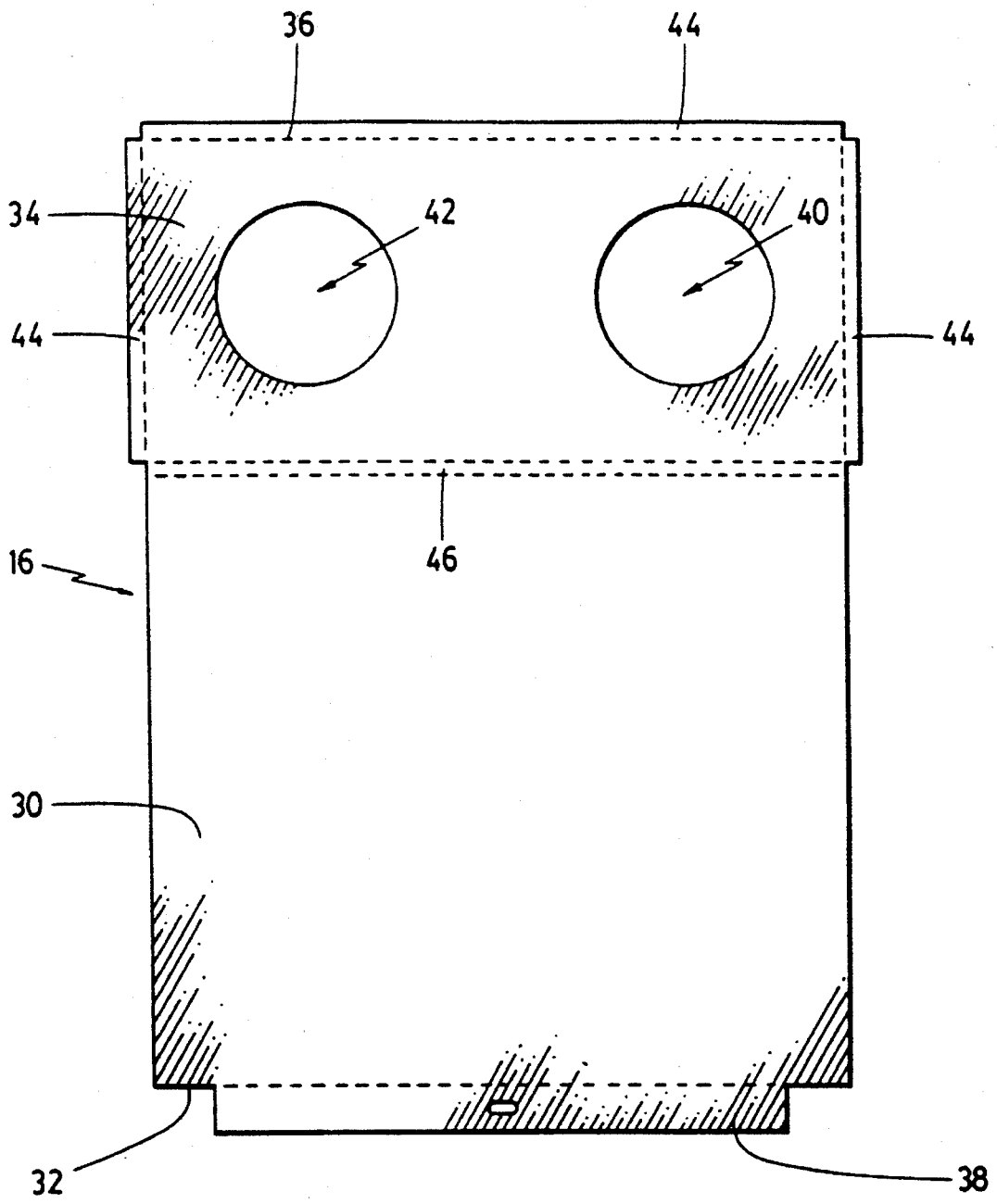
FIG. 2 is a "flattened" top view of the plate flue collar of the adaptor of FIG. 1.

In FIG. 2, fastener plate flue collar 16 is shown in greater detail. Fastener plate 16 consists of a generally flat slider plate portion 30 at its front end 32, and a slightly raised plate portion 34 at its rear end 36. An upstanding front flange 38 is located at the front end 32 of the plate 16. It will be understood when looking at FIGS. 2 and 3 that the components shown therein are illustrated as being "flattened" and dotted lines are used to denote where the components are bent. Thus, for example, upstanding flange 38 is shown in FIG. 2 as flat and in the same plane as plate 30, however it is understood that it is in fact perpendicular to plate 30.

Raised plate portion 34 has two circular holes 40 and 42 defined therein. Each hole 40 and 42 is provided with a coupling sleeve 41 and 43 (shown in FIG. 5) which extends perpendicularly upwardly from the respective hole. The coupling sleeves 41 and 43 are used for connecting to the lower ends of the flue liners, which are ducts located in the flue (chimney). Holes 40 and 42 align with the inlet and outlet openings on the top 12 of the firebox when the fastener plate 16 is mounted thereon. Raised plate portion 34 further includes three downward skirting flanges 44, which act to support the slightly raised plate portion 34. Plate portion 34 is raised relative to sliding plate portion 30, thereby creating a space between the top panel 12 of the insert and the plate portion 34. This space is bounded at its sides by the three flanges 44 and by upturned plate portion 46 and this space may be filled with insulating and sealing material to ensure that a substantially leak-proof seal is created between the fastener plate 16 and the top panel 12 of the fireplace insert.

Figure 3:
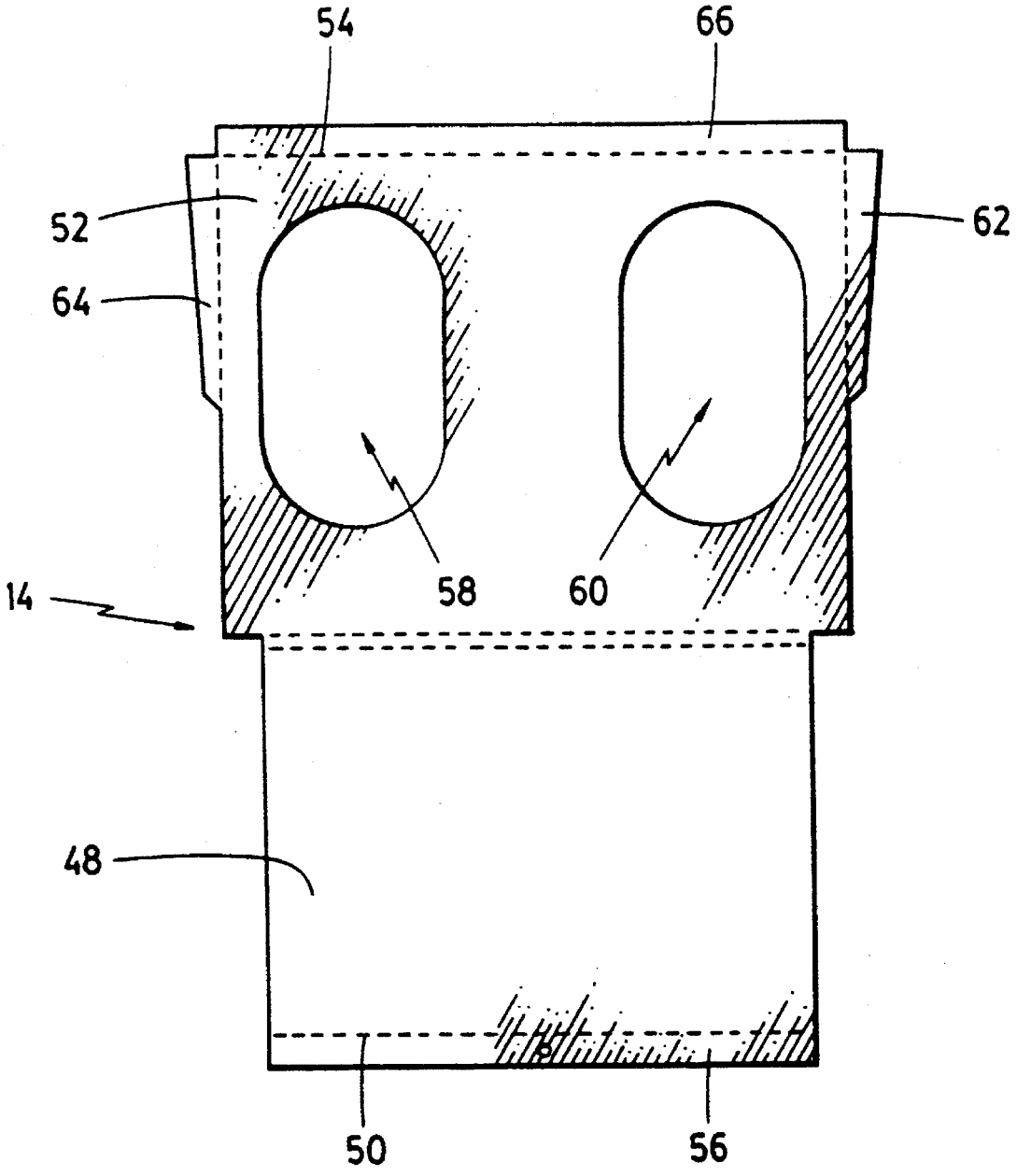
FIG. 3 is a "flattened" top view of the fastener plate flue collar of the adaptor of FIG. 1.

FIG. 3 shows the plate flue collar 14 in greater detail (in a "flattened" top view). Plate 14 has a flat plate portion 48 near its front end 50 and a slightly raised plate portion 52 near its rear end 54. An upstanding flange 56 is located at front end 50. A pair of oval-shaped openings 58 and 60 are defined in raised plate portion 52. Oval openings 58 and 60 are located such that they align with holes 40 and 42 in the fastener plate 16 when the adaptor 10 is mounted on the fireplace insert.

A pair of upstanding slanted flanges 62 and 64 are disposed on either side of raised plate portion 52. Both flanges 62 and 64 are shorter at their front ends and taller at their rear ends so that their upper edges are slanted upwardly from front to rear. A rear upstanding flange 66 may also be included on raised plate portion 52, but it is not necessary.

Figure 4:
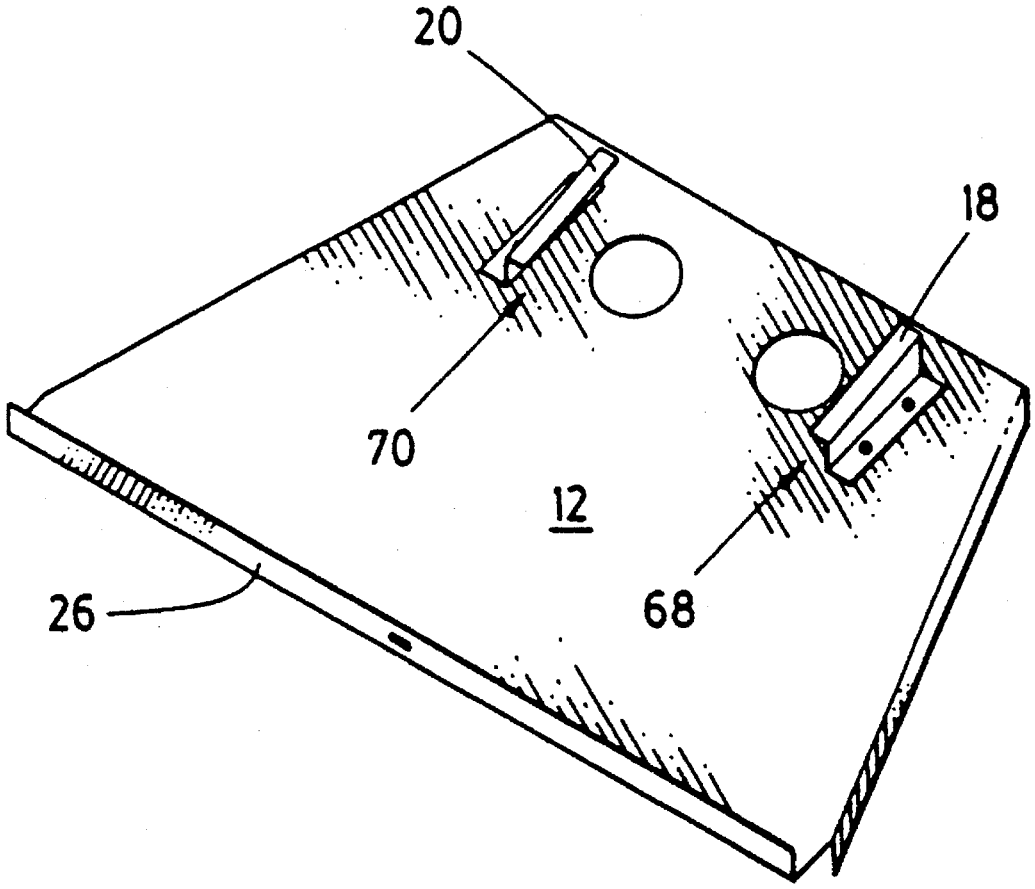
FIG. 4 is a perspective view of the rails located at the top of the direct vent fireplace insert for use with the adaptor of FIG. 1.

A pair of parallel rails 18 and 20, as shown in FIG. 4, are provided for mounting on the top panel 12 of the fireplace insert. Rails 18 and 20 act as brackets for the adaptor 10, and in particular for the slanted flanges 62 and 64 on plate 14. Rails 18 and 20 define channels 68 and 70 whose heights increase from front to rear of the rails. This increasing height of the channels 68 and 70 corresponds to the increased height of the slanted upper edge of the slanted flanges 62 and 64, allowing the slanted flanges 62 and 64 to fit snugly within the channels 68 and 70 when the adaptor 10 is mounted on top panel 12 of the fireplace insert.

In use, two flue liners are placed (inserted) in the flue (chimney) by either lowering one end down into the chimney or pushing one end up into the chimney. The bottom ends of the flue liners are then secured to the respective coupling sleeves 41 and 43 on the fastener plate flue collar 16 of adaptor 10 in a well known manner. The fireplace insert is then pushed into the fireplace cavity with the adaptor 10 sliding engageably within the rails 18 and 20, that is, the upstanding slanted flanges 62 and 64 on plate 14 engage within channels 68 and 70 defined by the rails 18 and 20. The increasing height and slant in both the flanges 62 and 64 and the rails 18 and 20 (the height increasing from front to back) allows the raised plate portion 52 of plate 14 to be forced downwardly onto the top panel 12 of the insert as the adaptor 10 is slid forwardly. This downward force on plate portion 52 is in turn applied to raised plate portion 34 of fastener plate 16, which is located immediately beneath it. Therefore, as adaptor 10 is slid forwardly on top panel 12, increasing downward pressure is applied to raised plate portion 34 of plate 16, creating a leak-proof seal between plate 16 and the firebox openings thus substantially preventing the escape of exhaust gases or intake of room air through leaks. Once adaptor 10 is fully mounted on the top panel 12 of the insert, adaptor 10 may be secured to the insert by means of a screw through the upstanding flange 26 at the front of the insert and flanges 38 and 56 on plates 16 and 14 respectively, of adaptor 10. As the screw is tightened, the adaptor 10 is caused to slide further forwardly, thereby increasing the downward pressure of the raised plate portion 34 onto the top panel 12 of the insert and further sealing plate portion 34 thereon.

Figure 6:
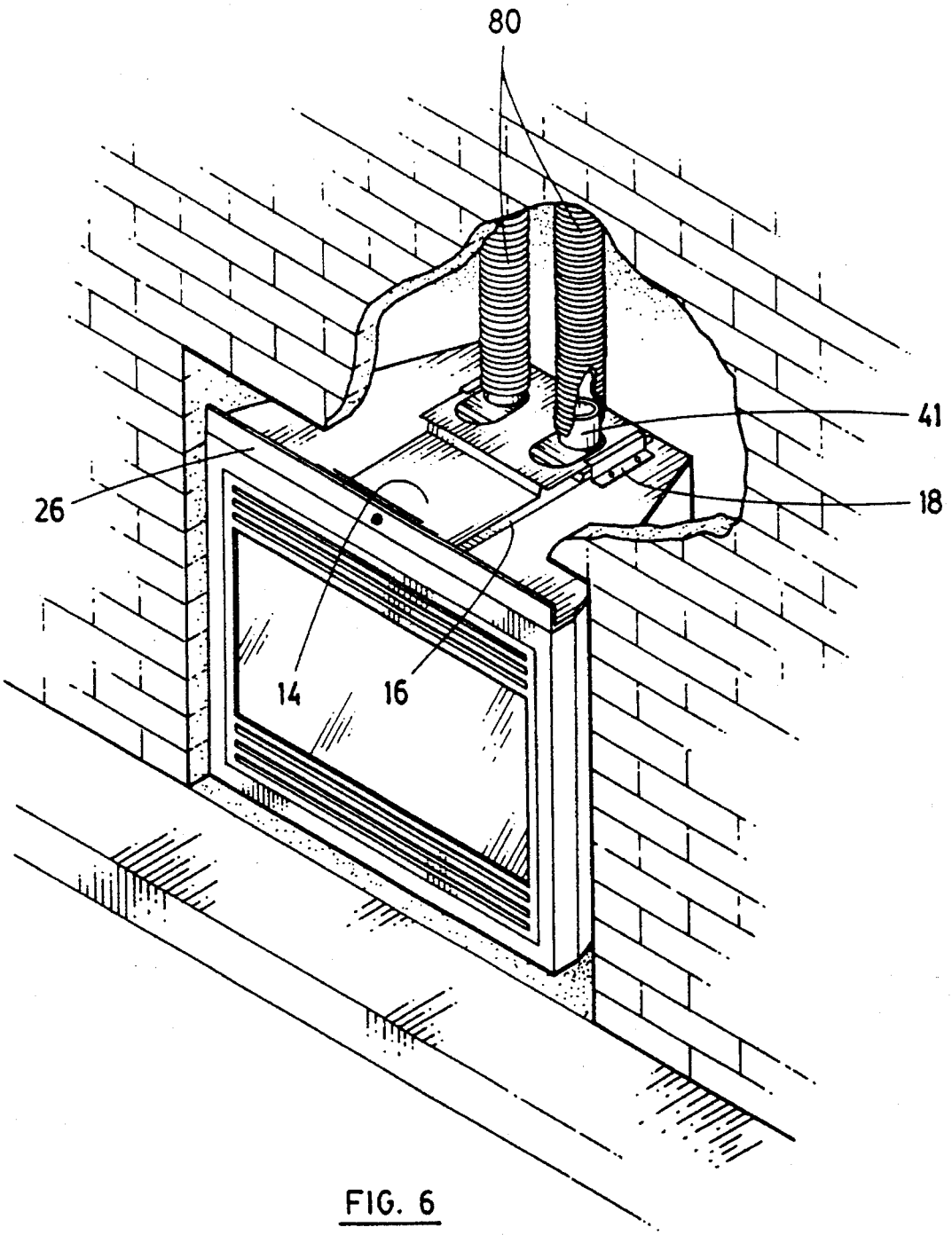
FIG. 6 is a perspective view of an adaptor for installing flue liners to direct vent fireplace inserts in accordance with the invention.

FIG. 6 is a perspective view of an adaptor for installing flue liners to direct vent fireplace inserts in accordance with the invention. Flue liners 80 extend from coupling sleeves 41. FIG. 6 shows the top panel of the fireplace insert and depicts the top of the direct vent gas fireplace as well as insulating and sealing material 19. FIG. 6 depicts a complete working embodiment of the adaptor.

Modifications and alterations to the method and adaptor of the present invention are contemplated and are within the scope of the present invention. For example, the present invention may have other means besides rails to apply downward pressure on the raised plate, such as snap-on clips or the like.

The embodiments of the invention in which an exclusive property or privilege is claimed are defined as follows:

1. A method of installing a direct vent gas fireplace insert, an exhaust flue liner and an inlet flue liner in an existing fireplace with a chimney, the direct vent gas fireplace insert comprising a firebox, a top panel defining an exhaust opening and an inlet opening formed in the top panel, and means for slidably receiving a plate flue collar, the method comprising the steps of:

(a) inserting the exhaust flue liner and inlet flue liner into the chimney whereby a lower end of the exhaust flue liner and a lower end of the inlet flue liner are accessible from the fireplace;

(b) aligning the plate flue collar on a fastener plate flue collar whereby an exhaust opening formed in the plate flue collar is above an exhaust opening formed in the fastener plate flue collar and an inlet opening formed in the plate flue collar is above an inlet opening formed in the fastener plate flue collar;

(c) coupling the lower end of the exhaust flue liner and the lower end of the inlet flue liner to the fastener plate flue collar, whereby the coupled lower end of the exhaust flue liner is over the exhaust opening formed in the fastener plate flue collar and the coupled lower end of the inlet flue liner is over the inlet opening formed in the fastener plate flue collar; and (d) slidably mounting the plate flue collar onto the means for slidably receiving the plate flue collar while inserting the fireplace insert into the existing fireplace until the exhaust opening formed in the plate flue collar and the exhaust opening formed in the fastener plate flue collar are substantially aligned with the exhaust opening formed in the top panel and the inlet opening formed in the plate flue collar and the inlet opening formed in the fastener plate flue collar are substantially aligned with the inlet opening formed in the top panel; and (e) forming a seal between the fastener plate flue collar and the top panel to seal the inlet opening from the exhaust opening.

2. The method of claim 1, wherein the step of slidably mounting the plate flue collar causes the fastener plate flue collar to be pushed down against the top panel of the fireplace insert to create a substantially leak-free seal between the firebox and the openings.

3. The method of claim 2, including forming said seal from insulating and sealing material in a space defined between the top panel and the fastener plate flue collar.

4. The method of claim 1, wherein the exhaust flue liner and inlet flue liner are inserted into the chimney such that the lower end of each extends below the chimney and into the existing fireplace.

5. The method of claim 1, wherein the coupling of the lower end of the exhaust flue liner to the fastener plate flue collar comprises the step of connecting the lower end of the exhaust flue liner to an exhaust sleeve extending upwardly from the edges of the exhaust opening formed in the fastener plate flue collar and the coupling of the lower end of the inlet flue liner to the fastener plate flue collar comprises the step of connecting the lower end of the inlet flue liner to an inlet sleeve extending upwardly from the edges of the inlet opening formed in the fastener plate flue collar.

6. The method of claim 1, wherein the plate flue collar comprises a first upstanding front flange, the fastener plate flue collar comprises a second upstanding front flange and the fireplace insert comprises a third upstanding flange on the forward edge of the top panel and wherein the step of slidably mounting the plate flue collar is completed by the first and second upstanding front flanges abutting the third upstanding front flange.

7. The method of claim 6, further comprising the step of fastening the first and second upstanding front flanges to the third upstanding front flange.

8. An adaptor assembly for installing a direct vent gas fireplace insert, an exhaust flue liner and an inlet flue liner in an existing fireplace with a chimney, the gas fireplace insert comprising a firebox, a top panel defining an exhaust opening and an inlet opening formed in the top panel, the adaptor assembly comprising:

(a) a plate flue collar defining an exhaust opening and an inlet opening formed in the plate flue collar;

(b) a fastener plate flue collar defining an exhaust opening and an inlet opening formed in the fastener plate flue collar;

(c) first means for coupling the fastener plate flue collar to a lower end of the exhaust flue liner whereby the lower end of the exhaust flue liner is over the exhaust opening formed in the fastener plate flue collar;

(d) second means for coupling the plate flue collar to a lower end of the inlet flue liner whereby the lower end of the inlet flue liner is over the inlet opening formed in the fastener plate flue collar;

(e) means operative for mounting on the top panel of the fireplace insert for slidably receiving the plate flue collar, whereby when the plate flue collar is fully received, the plate flue collar is aligned above the fastener plate flue collar and the exhaust opening formed in the top panel is in substantial alignment with the exhaust opening formed in the plate flue collar and the exhaust opening formed in the fastener plate flue collar and the inlet opening formed in the top panel is in substantial alignment with the inlet opening formed in the plate flue collar and the inlet opening formed in the fastener plate flue collar; and (f) seal means located between said fastener plate flue collar and said top panel to seal said exhaust opening from said inlet opening.

9. The adaptor assembly of claim 8, wherein the means for slidably receiving the slider plate comprises two slider brackets operative for mounting on the top panel, each of the slider brackets defining a channel having a height that increases from a front end to a back end of the slider bracket.

10. The adaptor assembly of claim 9, wherein the slider brackets are parallel to each other.

11. The adaptor assembly of claim 9, wherein the plate flue collar comprises a pair of upstanding side flanges, each upstanding side flange having a slanted upper edge adapted to be slidably received with a respective one of the channels.

12. The adaptor assembly of claim 8, wherein the second coupling means is a sleeve extending upwardly from the exhaust opening formed in the fastener plate flue collar and a second sleeve extending upwardly from the inlet opening formed in the fastener plate flue collar.

13. The adaptor assembly of claim 9, wherein the exhaust opening and inlet opening formed in the fastener plate flue collar are in a raised portion of the fastener plate flue collar supported by a plurality of downward skirting flanges, the raised portion defining a space between the raised portion and the top panel.

14. The adaptor assembly of claim 13, wherein said seal means includes insulating and sealing material in the space.

15. The adaptor assembly of claim 8, wherein the plate flue collar comprises a first upstanding front flange, the fastener plate flue collar comprises a second upstanding front flange and the fireplace insert comprises a third upstanding front flange on the forward edge of the top panel, whereby when the plate flue collar is fully received, the first upstanding front flange and second upstanding front flange abut the third upstanding front flange.

16. The fireplace insert of claim 14, wherein the first upstanding front flange, the second upstanding front flange and the third upstanding front flange each have a fastener engaging opening to permit a fastener to secure the plate flue collar and fastener flue collar to the fireplace insert.

* * * * *